US005160243A

United States Patent [19]

Herzner et al.

[11] Patent Number: 5,160,243

[45] Date of Patent: Nov. 3, 1992

[54] TURBINE BLADE WEAR PROTECTION SYSTEM WITH MULTILAYER SHIM

[75] Inventors: Fredrick C. Herzner, Fairfield; Jerome A. Juenger; Peter Wayte, both of Cincinnati, all of Ohio

[73] Assignee: General Electric Company, Cincinnati, Ohio

[21] Appl. No.: 641,230

[22] Filed: Jan. 15, 1991

[51] Int. Cl.[5] ..... F01D 5/30

[52] U.S. Cl. ..... 416/220 R; 416/241 R; 416/248; 416/500

[58] Field of Search ..... 416/204 A, 219 R, 220 R, 416/221, 241 R, 248, 224, 500

[56] References Cited

U.S. PATENT DOCUMENTS

| | | | |
|---|---|---|---|
| 2,874,932 | 2/1959 | Sorensen | 416/220 |
| 3,317,988 | 5/1967 | Endres | 416/221 |
| 3,784,320 | 1/1974 | Rossman et al. . | |
| 3,841,794 | 10/1974 | Bergmann | 416/221 |
| 3,891,351 | 6/1975 | Norbut . | |
| 4,169,694 | 10/1979 | Sanday | 416/219 R |
| 4,417,854 | 11/1983 | Cain et al. | 416/219 R |
| 4,462,756 | 7/1984 | Muggleworth et al. . | |
| 4,725,200 | 2/1988 | Welhoelter | 416/500 |
| 4,790,723 | 12/1988 | Wilson et al. | 416/220 R |
| 4,980,241 | 12/1990 | Hoffmueller et al. . | |

FOREIGN PATENT DOCUMENTS

| | | | |
|---|---|---|---|
| 0212603 | 10/1985 | Japan | 416/219 R |
| 0709636 | 6/1954 | United Kingdom | 416/241 R |
| 0836030 | 8/1956 | United Kingdom . | |

*Primary Examiner*—Edward K. Look
*Assistant Examiner*—Christopher M. Verdier
*Attorney, Agent, or Firm*—Carmen Santa Maria; Jerome C. Squillaro

[57] ABSTRACT

A metallic reinforced shim is attached to the dovetail of turbine or compressor blades. The shim reduces frictionally induced wear damage to the rotor. In one form, a single ply shim reinforced with a metallic doubler has an anti-fretting layer deposited on the shim face contacting the dovetail slot pressure face, and a doubler layer fastened to the anti-fretting layer in the non-contacting regions to prevent slippage of the shim on the blade. In another form, a multi-layer shim has two layers interposed between the blade dovetail and the disk dovetail slot, with the layers treated so that they do not readily slip relative to the titanium pieces, but do slip relative to each other. The shim is also reinforced with a metallic doubler. Fretting is confined to the consumable shim, and therefore the disk dovetail slot and the mating blade dovetails are not subject to surface degradation with corresponding reduction in fatigue capability.

15 Claims, 3 Drawing Sheets

TURBINE BLADE WEAR PROTECTION SYSTEM WITH MULTILAYER SHIM

BACKGROUND OF THE INVENTION

This invention relates to turbine engines, and, more particularly, to the reduction of frictionally induced wear damage within the rotors of the compressor and fan stages.

When two pieces of material rub or slide against each other in a repetitive manner, the resulting frictional forces can cause damage to the materials through the generation of heat or through a variety of fatigue processes generally termed fretting. Some materials systems, such as titanium contacting titanium, are particularly susceptible to such damage. When two pieces of titanium are rubbed against each other with an applied normal force, the pieces can exhibit a type of surface damage called galling after as little as as a hundred cycles. The galling increases with the number of cycles and can eventually lead to failure of either or both pieces by fatigue.

The use of titanium parts that can potentially rub against each other occurs in several aerospace applications. Titanium alloys are used in aircraft and aircraft engines because of their good strength, low density and favorable environmental properties at low and moderate temperatures. If a particular design requires titanium pieces to rub against each other, the type of fatigue damage just outlined may occur.

In one type of aircraft engine design, a titanium compressor disk, also referred to as a rotor, or fan disk has an array of dovetail slots in its outer periphery. The dovetail base of a titanium compressor blade or fan blade fits into each dovetail slot of the disk. When the disk is at rest, the dovetail of the blade is retained within the slot. When the engine is operating, centrifugal force induces the blade to move radially outward. The sides of the blade dovetail slide against the sloping sides of the dovetail slot of the disk, producing relative motion between the blade and the rotor disk.

This sliding movement occurs between the disk and blade titanium pieces during transient operating conditions such as engine startup, power-up (takeoff), power-down and shutdown. With repeated cycles of operation, the sliding movement can affect surface topography and lead to a reduction in fatigue capability of the mating titanium pieces. During such operating conditions, normal and sliding forces exerted on the rotor in the vicinity of the dovetail slot can lead to galling, followed by the initiation and propagation of fatigue cracks in the disk. It is difficult to predict crack initiation or extent of damage as the number of engine cycles increase. Engine operators, such as the airlines, must therefore inspect the insides of the rotor dovetail slots frequently, which is a highly laborious process.

Various techniques have been tried to avoid or reduce the damage produced by the frictional movement between the titanium blade dovetail and the dovetail slot of the titanium rotor disk. At the present time, the most widely accepted technique is to coat the contacting regions of the titanium pieces with a metallic alloy to protect the titanium parts from galling. The sliding contact between the two coated contacting regions is lubricated with a solid dry film lubricant containing primarily molybdenum disulfide, to further reduce friction.

While this approach can be effective in reducing the incidence of fretting or fatigue damage in rotor/blade pieces, the service life of the coating has been shown to vary considerably. Furthermore, the process for applying the metallic alloy to the disk and the blade pieces has been shown to be capable of reducing the fatigue capability of the coated pieces. There exists a continuing need for an improved approach to reducing such damage and assure component integrity. Such an approach would desirably avoid a major redesign of the rotor and blades, which have been optimized over a period of years, while increasing the life of the titanium components and the time between required inspections. The present invention fulfills this need, and further provides related advantages.

A new approach to reduce the incidence of fretting in high temperature components described in European Patent Application 89106921.3 utilizes two independent, but superposed foils having material contact surfaces with a low coefficient of friction, but surfaces which mate with the dovetail and dovetail slot having high coefficients of friction. The foils allow sliding movement along the material contact surfaces having the low coefficient of friction, but prevent sliding between the foil and the mating parts due to the high coefficient of friction. Experience with this type of design has shown that each of the thin foils gradually work their way out of the dovetail slot region, leaving the blade dovetail and rotor dovetail slot in contact, resulting in fretting. In an attempt to reduce this movement, in one embodiment, the foils have formed flanges. The flanges necessarily are small because of the small gap between the blade dovetail and rotor dovetail slot, and although providing some improvement, are not expected to eliminate the problem of gradual movement of the foil.

SUMMARY OF THE INVENTION

The present invention provides an approach to reducing fatigue-induced damage from fretting to titanium blades and titanium rotors of the compressor or fan of a gas turbine induced by sliding contact of the blade dovetail and the rotor dovetail slot. The wear life of the titanium parts is increased, as compared with prior approaches, and the life is also more consistent. Neither the rotor nor the blades require special coatings to reduce wear, and therefore are not subject to special coating processes which can adversely affect base material properties. When the wear life of the shim of the present invention is reached, the engine may be readily refurbished and prepared for further service. During the refurbishment, it is not necessary to perform a major disassembly of the engine. The expensive rotor is not scrapped or reworked in the refurbishment.

In accordance with the invention, a rotor and blade assembly comprises a titanium rotor having a dovetail slot in the circumference thereof, the dovetail slot including sidewalls and a bottom. A titanium blade having a dovetail is sized to fit into the dovetail slot and contact the rotor along a pair of contacting regions on the sidewalls of the dovetail slot, one contacting region on each side of the dovetail slot, there remaining a non-contacting region between the dovetail slot bottom and the blade dovetail bottom. A reinforced shim is disposed in this non-contacting region between the blade dovetail bottom and the rotor dovetail slot bottom, the reinforced shim including means for inhibiting fretting wear of the titanium blade dovetail and the titanium rotor in the contacting region of the dovetail slot. As used herein, the term "titanium" includes both pure titanium and titanium alloys.

Further in accordance with the invention, a reinforced shim configured for placement between a titanium rotor and titanium blade, the titanium rotor having dovetail slots in the circumference thereof, each dovetail slot including oppositely disposed sidewalls originating on the circumference of the rotor disk and terminating at a bottom located on an inner diameter of the rotor, each slot further defined by at least two oppositely disposed sidewalls diverging away from each other in the inward direction, and the titanium blade having a dovetail sized to fit into the dovetail slot and contact the rotor along a pair of contacting regions on the sidewalls of the dovetail slot, one contacting region on each side of the dovetail slot, there remaining a non-contacting region between the blade dovetail bottom and the rotor dovetail slot bottom, comprises at least two joined material layers, one of which is a strengthening doubler which is joined to means for inhibiting fretting wear of the titanium dovetail and the titanium rotor in the contacting region of the dovetail slot.

Two preferred configurations of the invention have been identified. In one, the reinforced shim includes an anti-fretting layer on the outer surface which at least contacts the diverging sections of the dovetail slot in the contacting regions, also referred to as pressure faces. The anti-fretting layer has two sides, one side which contacts the dovetail and an opposite side which contacts the dovetail slot in the contact region, thereby preventing contact between the dovetail and dovetail slot in this region. The material comprising the anti-fretting layer does not exhibit fretting when rubbed against titanium. The material used for the anti-fretting layer must be a material other than titanium. Additionally, there is a strengthening doubler overlying at least that portion of the anti-fretting layer that is disposed over the non-contacting region. The doubler does not overlie that portion of the anti-fretting layer that is disposed over the contacting regions. The doubler is permanently joined to the anti-fretting layer in the non-contacting region so that the shim is a single part, but having two layers. The anti-fretting layer is sacrificial, to be worn away as a result of sliding contact with the blade dovetail the sides of the dovetail slot and the strengthening doubler layer.

In the other preferred configuration, a multilayer reinforced shim includes a first layer having an inner surface and an outer surface adjacent the rotor dovetail slot. The first layer has a slip-inhibiting material as its outer surface which contacts the pressure face regions of the rotor dovetail slot in the vicinity where the blade dovetail and rotor dovetail slot sidewalls would otherwise contact. The inner surface of the first layer is a slip-promoting material oppositely disposed from the outer surface. A second layer of the shim, having an inner and outer surface, lies adjacent the blade dovetail. The second layer can have a slip-inhibiting material on an inner surface lying adjacent the contacting regions of the blade dovetail, and a slip-promoting material on an outer surface oppositely disposed from the inner surface and in contact with the inner surface of the first layer. The slip-inhibiting material of each layer is in contact with the adjacent titanium piece and acts to inhibit sliding movement between the shim and the titanium piece. The slip-promoting material of the first layer is in contact with the slip-promoting material of the second layer such that relative movement between the blade dovetail and the rotor dovetail slot is accommodated by sliding of the slip-promoting materials, and thence the two layers of the shim, over each other. The first layer is reinforced with a strengthening doubler which overlies a portion of the first layer that is disposed over the non-contacting region, but does not overlie that portion of the first layer that is disposed over the contacting regions. The strengthening doubler is permanently joined to the first layer in the non-contacting region, but is made from a different material than the first layer.

The present invention permits the use of other fatigue reducing techniques. The occurrence of fatigue damage may be further reduced by surface hardening, lubrication, or any other technique known in the art, as applied to the blade dovetail, the rotor dovetail slot, or the shim. However, the reinforcing features of the shim of this invention prevents gradual movement of the shim from the region between the blade, dovetail and the rotor dovetail slot, thereby assuring that the shim remains in position to prevent contact between the blade and the rotor in the contact region during engine operation. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
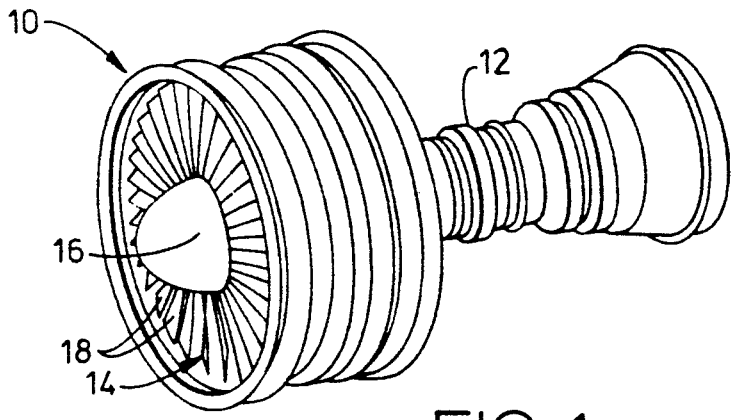
FIG. 1 is a perspective view of a gas turbine engine.

The reinforced shim of the present invention is preferably used in conjunction with an aircraft jet engine 10 such as that shown in FIG. 1. The jet engine 10 includes a gas turbine 12 with a bypass fan 14 driven thereby. The bypass fan 14 includes a fan disk or rotor 16 having a plurality of fan blades 18 mounted thereto. The use of the present invention will be discussed in relation to the fan rotor and blades, but is equally applicable to the compressor rotor and blades in the compressor portion of the gas turbine 12. The fan and compressor portions of a turbine engine generally operate at lower temperatures that the portions of the engine aft of the compressor. These temperatures are limited to about 600° F. and below. The fan rotor 16, fan blades 18, compressor disk, and compressor blades are made of titanium alloys, in the embodiments discussed herein. However, the rotor or disk and the mating blades may be made of any alloy or combination of alloys which tend to gall or fret when brought into mating contact with one another, and in particularly, when the mating surfaces move relative to one another.

Figure 2:
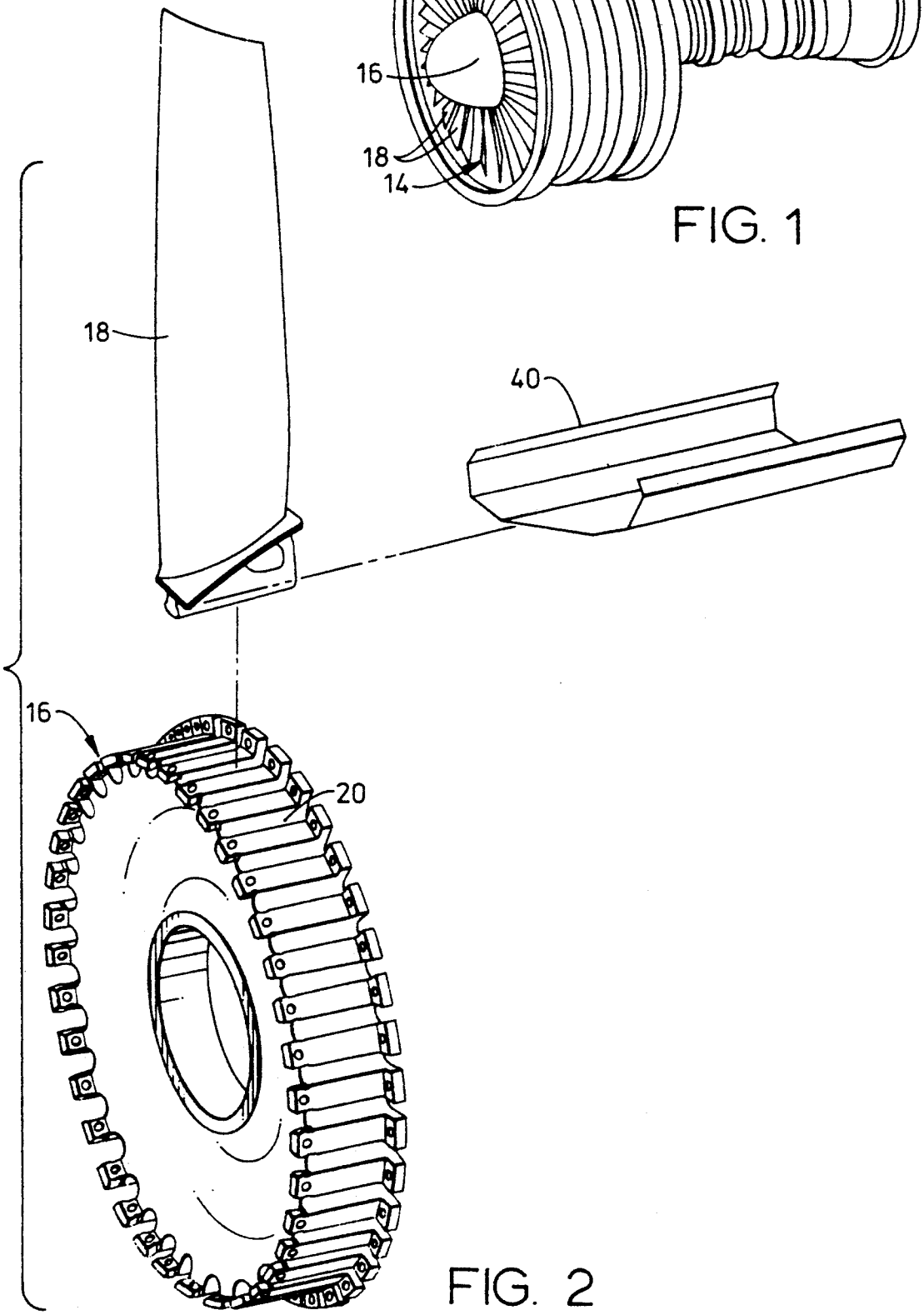
FIG. 2 is a perspective exploded view of a fan rotor, fan blade, and inserted reinforced shim.
Figure 3:
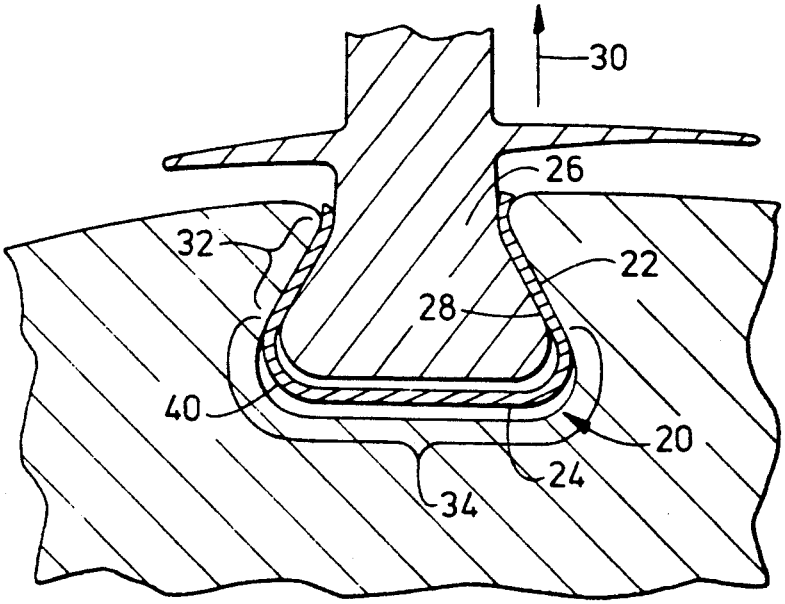
FIG. 3 is a side elevational view of a portion of the assembled fan rotor and fan blade, with a multilayer reinforced shim positioned therebetween.

The assembly of the fan blades 18 to the fan rotor 16 is illustrated in greater detail in FIGS. 2 and 3. The rotor 16 has a plurality of dovetail slots 20 around its circumference, opening circumferentially outward.

Each dovetail slot 20 has sloping side walls 22 diverging in a direction from the circumference toward the inward portion of the disk or rotor, but terminating at a bottom 24. Each fan blade 18 has at its lower end a dovetail 26 with sides 28 sloping outward in a direction from the blade body to the dovetail bottom. The blade dovetail 26 is configured and sized to slide into the rotor dovetail slot 20, as shown in FIG. 3.

When the rotor 16 is at rest, each blade dovetail 26 is retained within the rotor dovetail slot 20. The bottom of the blade dovetail may contact the bottom of the rotor dovetail slot. When the jet engine 10 is operated, rotation of the rotor 16 about a central shaft results in movement of the blade 18 outwardly due to centrifugal force, in the direction of the arrow 30 of FIG. 3. The dovetail side 28 then bears against the rotor dovetail slot side wall 22 to secure the blade 18 within the rotor dovetail slot 20 and prevent the blade 18 from being thrown clear of the rotor 16. The sliding motion of the blade dovetail combined with the dovetail contact pressure and the coefficient of friction produce shearing forces on both the disk and the the blade. As will be apparent from an inspection of FIG. 3, there is a loaded contact region, generally indicated by numeral 32, between the dovetail side 28 and the slot side wall 22, and a non-contact region, generally indicated by numeral 34 where there is no such loaded contact.

As the jet engine 10 operates from rest, through flight operations, and then again to rest, constituting what is generally referred to as a "cycle", the blade 18 is pulled in the direction 30 with varying loads. The blade dovetail side 28 and the rotor dovetail slot side wall 22 slide past each other by a distance that is small, typically about 0.010 inch or less, but that can nevertheless cause fretting fatigue damage. Of most concern is the damage to the rotor 16 as small cracks form after repeated cycles. Such cracks can extend into the rotor 16 from the dovetail slot side wall 22 and can ultimately lead to failure of the rotor.

Figure 4:
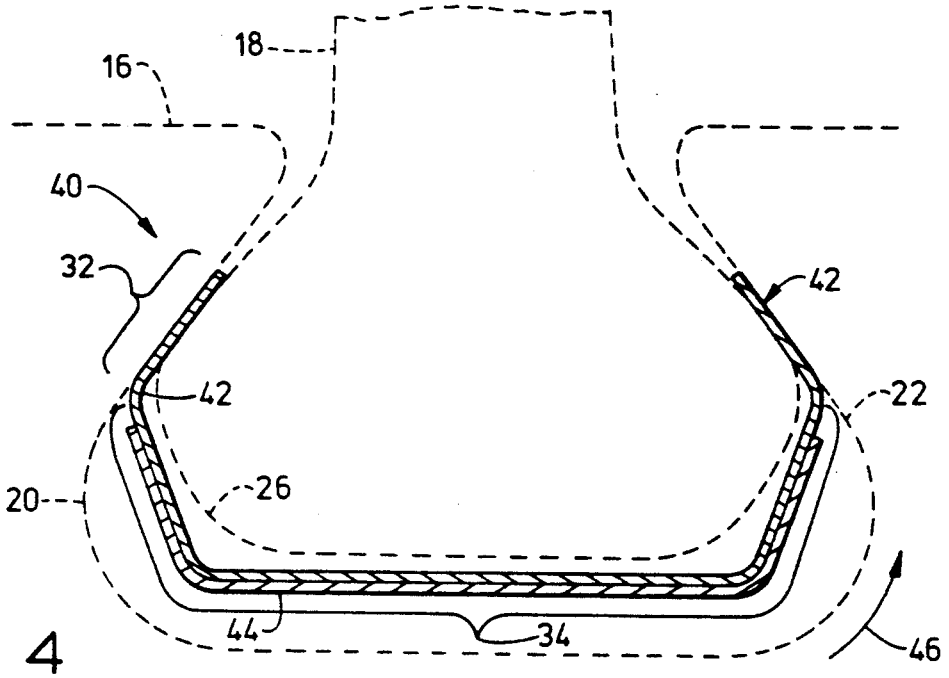
FIG. 4 is a side elevational view of a first preferred embodiment of the reinforced shim.
Figure 5:
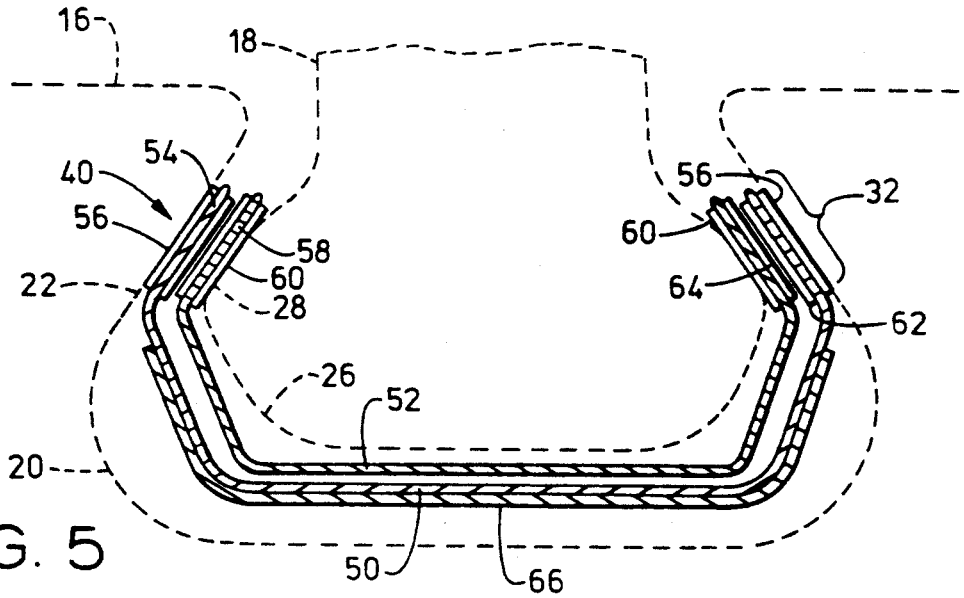
FIG. 5 is a side elevational view of a second preferred embodiment of the reinforced multilayer shim.

According to the invention, the wear and fatigue damage that would otherwise occur at the pressure faces because of the sliding motion at the blade dovetail sides 28 and the slot side walls 22 of the rotor 16 is reduced by inserting a reinforced shim 40 between the blade dovetail 26 and the dovetail slot side walls 22. The placement of the shim 40 is illustrated in FIGS. 2 and 3, and the detailed constructions of two preferred embodiments of the shim are illustrated in FIGS. 4 and 5. The use of the strengthening doubler in each preferred embodiment allows each shim to be thicker, about 0.015 inches to about 0.04 inches and preferably greater than 0.020 inches to about 0.035 inches. The strengthening doubler eliminates concerns about movement of the shim from the contact region due to unseating loads or other mechanisms.

The shim 40 is a thin, layered sheet formed so that it attaches to the blade dovetail 26 and is retained during service between the blade dovetail 26 and the rotor slot side wall 22. The form of the shim 40 is generally a constricted U-shape, with the upper portion of the legs of the U bent slightly toward each other. The shim 40 is sufficiently long that it extends around the blade dovetail bottom and over the entire contacting surface 32 between the blade dovetail 26 and the rotor dovetail slot side walls 22, completely separating the blade dovetail sidewall 28 and the rotor dovetail slot side walls 22 so that they cannot contact each other along the contacting surface 32. The blades are assembled to the rotor by sliding a shim onto each blade and inserting the blade/shim assembly into the rotor dovetail slot in the conventional manner.

In accordance with a first preferred embodiment of the invention, a rotor and blade assembly comprises a titanium rotor having a dovetail slot in the circumference thereof, the dovetail slot including sidewalls diverging in a direction from the circumference toward the inward portion of the disk or rotor, but terminating at a bottom located at an inner diameter of the rotor; a titanium blade having a dovetail sized to fit into the rotor dovetail slot and contact the rotor dovetail sidewalls along a pair of contacting regions, one contacting region on opposed sides of the dovetail slot, there remaining a non-contacting region between the blade dovetail and the rotor dovetail slot; and a reinforced shim, disposed between the blade dovetail and the rotor dovetail slot, the shim including an anti-fretting layer in at least the contacting region, the anti-fretting layer being a material that does not fret when rubbed against titanium, a doubler overlying and affixed to a portion of the shim that is disposed over the non-contacting region, but not overlying that portion of the shim that is disposed over the contacting regions and a joint between the anti-fretting layer and the doubler in the non-contacting region.

Further in accordance with this embodiment of the invention, a reinforced shim is configured for placement between a titanium rotor and a titanium blade, the titanium rotor having a rotor dovetail slot in the circumference thereof, the rotor dovetail slot including sidewalls diverging in a direction from the circumference toward the inward portion of the disk or rotor, but terminating at a bottom located along an inner diameter of the disk, and a titanium blade having a dovetail sized to fit into the rotor dovetail slot and contact the rotor along a pair of oppositely disposed contacting regions on the sidewalls of the rotor dovetail slot, one contacting region on each side of the rotor dovetail slot, there remaining a non-contacting region between the blade dovetail and the rotor dovetail slot, the shim comprising an anti-fretting layer interposed between the blade dovetail and the rotor dovetail slot, over both the contacting and the non-contacting regions, the anti-fretting layer being a material that does not exhibit fretting when rubbed against titanium, a doubler overlying and affixed to a portion of the anti-fretting layer that is disposed over the non-contacting region, but not overlying that portion of the anti-fretting layer that is disposed over the contacting regions, and a joint between the doubler and the anti-fretting layer in the non-contacting region.

The first preferred form of the shim 40 is illustrated in detail in FIG. 4. The shim 40 in the shape of a constricted U includes an anti-fretting layer 42 configured so that it extends around the end of the blade dovetail 26, which is shown in phantom lines. The anti-fretting layer 42 is retained between the blade dovetail 26 and the rotor dovetail slot 20 in the contacting region 32 where the forces between the blade 18 and the rotor 16 are borne. One side of the anti-fretting layer contacts the blade dovetail while the opposite side contacts the rotor dovetail.

The shim 40 also includes a doubler 44 as a second layer that overlies and is permanently affixed to the anti-fretting layer 42. The doubler 44 extends around only the lower portion of the anti-fretting layer. The doubler 44 is joined to the anti-fretting layer in a joint (not shown) located in the noncontacting regions 34, where no high load is borne between the blade 18 and the rotor 16. That is, the doubler does not lie between the blade dovetail 26 and the rotor dovetail slot 20 in the high load-bearing contacting regions 32.

The anti-fretting layer 42 is made of a material that does not induce fretting or other type of fatigue damage in titanium and titanium alloys, even when rubbed against titanium and titanium alloys with a high normal (perpendicular) force, even with repeated cycles of rubbing motion. Such a material, suitable for use up to about 600° F., will normally be softer than titanium, so that it, not the titanium, sustains damage and is worn away by the frictional contact. One such material, which is presently preferred for forming the anti-fretting layer 42, is phosphor bronze. A most preferred composition for such a phosphor bronze is about 4% to about 6% tin, about 0.05% to about 0.15% phosphorous and the balance copper. The phosphor bronze may be heat treated by any conventional method. However, the preferred temper for these alloys is one which provides at least about 12% elongation in a tensile test, and a tensile strength of at least 80,000 psi.

While phosphor bronze of the above composition is the preferred material for the anti-fretting layer, other materials which may be used include copper-nickel alloys having nominal compositions of about 9% nickel, about 2.5% tin and the balance copper; aluminum-bronze alloys having nominal compositions of about 10% aluminum, about 1% iron and the balance copper or copper-beryllium alloys. All of the above alloys are well-known and available commercially.

Testing has shown that the use of a single layer shim made only of anti-fretting material reduces damage to the titanium for a short time, but the single layer shim can rotate circumferentially about the blade dovetail, as in the direction 46 illustrated in FIG. 4. Concentrated peak stresses can occur at localized areas on the anti-fretting layer in location 32 leading to premature destruction of the anti-fretting layer. The absence of the anti-fretting layer adjacent the rotor pressure face can lead to fretting of the rotor. One of the contacting regions 32 is quickly left unprotected, and damage is incurred. The single-layer structure can also eventually work its way out of the slot, again leaving the rotor without the benefit of anti-fretting protection.

To prevent such movement of the anti-fretting layer 42, a second layer, the doubler 44, is joined to the anti-fretting layer 42, at a joint located away from the contacting region 32. The doubler 44 has a higher strength than the anti-fretting layer. The doubler 44 preferably extends near to, and almost touching, the contacting region 32. With the doubler 44 joined thereto, the integral shim is physically prevented from moving in the direction 46. This characteristic of the shim is attributed to the high strength doubler, which also has excellent stiffness.

The doubler 44 may be constructed of any convenient copper-base, nickel-base, cobalt-base, or iron-base material. Because the doubler 44 is not interposed between the load-bearing portions of the contacting regions 32, it need not be selected to avoid damage to the titanium. Instead, it is chosen for rigidity and strength, for formability, and for joinability to the anti-fretting layer 32. The preferred material for the doubler 44 is Inconel-718. Alternative materials include Haynes 25, beryllium copper alloys and austenitic stainless steels.

The shim 40 of FIG. 4 is manufactured in the following manner. The anti-fretting layer 42 and the doubler 44 are separately rolled to the preferred thicknesses, which will depend upon the precise configuration of the dovetail 26 and the dovetail slot 20. However, in a typical application, the anti-fretting layer 42 is about 0.018 inches thick, and the doubler 44 is about 0.015 inches thick, so that the shim thickness is about 0.033 inches. The anti-fretting layer 42 and the doubler 44 are separately stamped or compression-formed using stamping or die forming techniques that are well-known in the art to precisely achieve the precise final configuration, typically such as shown in FIG. 4. The anti-fretting layer 42 and the doubler 44 are brazed, riveted or spot welded together to form the reinforced shim 40, so that after assembly into the rotor dovetail slot, the doubler 44 does not extend into the contact regions. Spot welding is the preferred method of joining the anti-fretting layer 42 and doubler 44. Brazing is an acceptable technique for joining a doubler and an anti-fretting layer made of the same material, such as an annealed IN-718 anti-fretting layer and a hardened IN-718 doubler. Brazing allows the joint region to extend over the entire non-contact region 34, if desired. The shim 40 is then assembled onto the blade 18 and inserted into the dovetail slot 20 of the rotor 16 using conventional methods.

A second preferred embodiment is the multilayer reinforced shim 40, illustrated in FIG. 5. In accordance with this aspect of the invention, a titanium rotor and blade assembly comprises a titanium rotor having a dovetail slot in the circumference thereof, the dovetail slot including sidewalls diverging in a direction from the circumference toward the inward portion of the disk or rotor, but terminating at a bottom located on an inner diameter of the rotor; a titanium blade having a dovetail sized to fit into the rotor dovetail slot and contact the rotor along a pair of opposed contacting regions on the sidewalls of the dovetail slot, one contacting region on each side of the rotor dovetail slot; and a reinforced shim disposed between the blade dovetail and the rotor dovetail slot, the shim including a first layer having an inner surface and an outer surface, the outer surface having a slip-inhibiting material lying adjacent at least the contacting regions of the rotor dovetail slot, and a slip-promoting inner surface; a second layer adjacent the blade dovetail, the second layer optionally having a slip-inhibiting material on an inner surface lying adjacent the contacting regions of the blade dovetail, and a slip-promoting material on an outer surface oppositely disposed from the inner surface, the slip-inhibiting material of each layer being in contact with the adjacent titanium piece and acting to inhibit sliding movement between the shim and the titanium piece, and the slip-promoting inner surface of the first layer being in contact with the slip-promoting outer surface of the second layer such that relative movement between the blade dovetail and the rotor dovetail slot is accommodated by sliding of the slip-promoting surfaces over each other; and, a doubler overlying a portion of the first layer that is disposed over the non-contacting region, but not overlying that portion of the first layer that is disposed over the contacting regions and joined to the first layer at a joint located in the non-contacting region.

Further in accordance with this aspect of the invention, a reinforced shim configured for placement between a titanium rotor and a titanium blade, the titanium rotor having a dovetail slot in the circumference thereof, the dovetail slot including sidewalls diverging in a direction from the circumference toward the inward portion of the disk or rotor, but terminating at a bottom located on an inner diameter of the rotor, and the titanium blade having a dovetail sized to fit into the dovetail slot and contact the rotor along a pair of opposed contacting regions on the sidewalls of the rotor dovetail slot, one contacting region on each side of the rotor dovetail slot, comprising a first layer adjacent the rotor dovetail slot, the first layer having a slip-inhibiting material on an outer surface lying adjacent the contacting regions of the rotor dovetail slot, and a slip-promoting material on an inner surface oppositely disposed from the outer surface, a second layer adjacent the blade dovetail, the second layer having a slip-inhibiting material on an inner surface lying adjacent the contacting regions of the blade dovetail, and a slip-promoting material on an outer surface oppositely disposed from the inner surface, the slip-inhibiting material of each layer being in contact with the adjacent titanium piece and acting to inhibit sliding movement between the shim and the titanium piece, and the slip-promoting material of the first layer being in contact with the slip-promoting material of the second layer such that relative movement between the blade dovetail and the rotor dovetail slot is accommodated by sliding of the slip-promoting materials over each over; and a high strength doubler attached to the first layer.

Referring to FIG. 5, the shim 40 includes two layers 50 and 52 of material nested together but not affixed together, each of which extends around the end of the dovetail 26. Each of the layers 50 and 52 lie between the dovetail 26 and the dovetail slot 20 in both the contacting regions 32 and the non-contacting regions 34. As illustrated, the second layer 52 is nested inside the first layer 50. The layers 52 and 54 are made of a strong material, preferably an alloy such as IN-718. Alternative materials that may be used include Haynes 25 and austenitic stainless steels.

That portion 54 of the first layer 50 lying directly adjacent the contacting region 32 of the dovetail slot 20 is covered on its outside surface (adjacent the dovetail slot 20) with a coating 56 of a material that inhibits slip between the first layer 50 and the titanium side wall 22. Similarly, that portion 58 of the second layer 52 lying directly adjacent the contacting region 32 of the dovetail 26 is covered on its inside surface (adjacent the dovetail 26) with a coating 60 of a material that inhibits slip between the second layer 52 and the side 28 of the titanium dovetail 26.

Preferred materials for the coatings 56 and 60 are high-friction, soft materials suitable for use up to about 600° F. such as copper or aluminum-bronze having a composition of about 10% aluminum, 1% iron and the balance copper and incidental impurities. The preferred method of application of the coatings to the layers is a thermal spray process which results in a rough surface topography after application, further inhibiting sliding motion. The coatings 56 and 60 are usually made of the same material, although this is not necessary. The coatings 56 and 60 inhibit sliding movement of the first and second layers 50 and 52 against the respective titanium pieces which they contact. Ideally, there would be no relative movement between the first layer 50 and the slot side wall 22, and no relative movement between the second layer 52 and the dovetail sidewall 28. A small amount of movement is acceptable, however.

The inwardly facing surface 54 of the first layer 50 is covered with a coating 62 of a material that promotes slip. The outwardly facing surface 58 of the second layer 62 is covered with a coating 64 of a material that promotes slip. The coatings 62 and 64 are directly facing each other, and slide against each other when the shim 40 is assembled and then placed into the slot 20.

The preferred materials for the coatings 62 and 64 are low-friction, hard materials. Most preferably, the coatings 62 and 64 are formed of molybdenum disulfide dry film lubricant which may be applied by spraying or brushing. The material disclosed in concurrently filed and commonly assigned application Ser. No. 07/641,299, incorporated herein by reference, and comprising poly(tetrafluoroethylene), bentonite, inorganic oxide particles and an epoxy is also preferred. Alternative materials for the coatings 62 and 64 include polytetrafluoroethylene, also known by the trade name Teflon, titanium nitrides or combinations of these materials. Teflon may be applied by spraying on brushing, while titanium nitride may be applied by any suitable deposition technique well known to those skilled in the art. Ideally, the coatings 62 and 64 would slip over each other with no friction, but a low coefficient of friction is satisfactory. A reinforcing doubler 66 extends around the outside surface of the first layer in the non-contacting region, but does not extend to that portion 54 of the first layer 50 lying directly adjacent the contacting region 32 of the dovetail slot. The doubler 66 is joined to the first layer in the non-contacting region by a suitable process such as by spot welding or by brazing. The doubler 66 is a high strength material, constructed of any nickel-base, cobalt base or iron base material and is chosen for rigidity and strength. The doubler 66 prevents movement of the shim from the region between the blade dovetail and the dovetail slot. The joint (not shown) may be a spot weld or a braze which extends over the entire non-contact region, if desired.

The dimensions of the elements of the shim 40 of FIG. 5 are selected for compatibility with the particular rotor/blade system with which it is to be used. In an exemplary case, the layers 50 and 52 are each IN-718 having a thickness of about 0.012 inches. The layers are formed by the same manufacturing techniques as described previously in relation to the shim 40 of FIG. 4, but in the shim of FIG. 5 the layers 52 and 54 are not affixed together. The doubler may be any high strength material, and has a thickness of about 0.015 inches. The preferred material for the slip-inhibiting coatings 56 and 60 is aluminum bronze applied by thermal spraying to a thickness of about 0.005 inches. The preferred material for the slip-promoting coatings 62 and 64 is molybdenum disulfide as a principle ingredient, applied by brushing or spraying to a thickness of about 0.002 inches to about 0.004 inches The material disclosed in concurrently filed and commonly assigned application Ser. No. 07/641,299, comprising poly(tetrafluoroethylene), bentonite, inorganic oxide particles and an epoxy is also preferred.

In operation of the shim 40 of FIG. 5, the layer 50 slips very little relative to the rotor dovetail slot side walls 22, being retained in position both by the doubler 66 and the slip-inhibiting coating. The layer 52 slips very little relative to the blade dovetail side walls 28. Damage to the titanium pieces is thereby minimized, because there is little opportunity for sliding damage. Instead, relative movement between the rotor dovetail slot side walls 22 and the blade dovetail side walls 28 is accommodated by movement of the layer 52 over layer 50, on the slip-promoting coatings 62 and 64.

The principle of operation of the multilayer shim of FIG. 5 differs from that of the shim of FIG. 4. The shim of FIG. 5 accommodates the relative movement between the dovetail side 28 and the slot side wall 22, in the contacting region 32, by sliding movement within the shim itself. There is little sliding movement between the shim and the titanium pieces. By contrast, the shim of FIG. 4 accommodates relative movement by sliding of the anti-fretting layer of the shim against the bearing surface of each titanium part, which does not damage the titanium because of the choice of the material used in the anti-fretting layer.

The use of the shim of the present invention in engine applications has delayed the onset of fretting. Use of a reinforced shim of this invention made from IN-718 and bronze has delayed the onset of fretting for greater than 2000 cycles of operation. The use of a bronze shim has delayed the onset of fretting for more than 1500 cycles. In contrast, fretting has been observed in a system having no shim, but with titanium blades inserted in titanium rotors, but coated with a molybdenum disulfide lubricant, in less than about 200 cycles. Thus, the advantage of the shim of the present invention in reducing the onset of fretting and the consequent reduction or elimination in fatigue damage in blade/disk systems can be readily seen, since the number of engine cycles before the onset of fretting is increased by a factor of seven to greater than 10, depending on the shim selected.

Although the present invention has been described in connection with specific examples and embodiments, it will be understood by those skilled in the arts involved that the present invention is capable of modification without departing from its spirit and scope as represented by the appended claims.

What is claimed is:

1. An assembly for a turbine engine, comprising:

a titanium rotor having a dovetail slot in a rotor circumference thereof, the dovetail slot including at least a pair of sidewalls diverging in a direction from the circumference toward an inward portion of the rotor, and terminating at a bottom;

a titanium blade having a dovetail sized to fit into the dovetail slot and contact the rotor along a pair of contacting regions on the inwardly diverging sidewalls of the dovetail slot, one contacting region being located on each side of the dovetail slot, there remaining a non-contacting region between the blade dovetail and the dovetail slot; and a shim disposed between the blade dovetail and the dovetail slot, the shim including (a) an anti-fretting layer interposed between the dovetail and the dovetail slot over both the contacting regions and the non-contacting region, the anti-fretting layer being formed of a material that does not exhibit fretting when rubbed against titanium, (b) a doubler overlying only that portion of the anti-fretting layer that is disposed over the non-contacting region, and (c) a joint joining together the anti-fretting layer and the doubler in the non-contacting region.

2. The assembly of claim 1, wherein the anti-fretting material is phosphor bronze.

3. The assembly of claim 1, wherein the doubler is formed of a material selected from the group consisting of a copper-base alloy, a nickel-base alloy, a cobalt-base alloy, and a steel.

4. The assembly of claim 1, wherein the joint is a weld joint.

5. The assembly of claim 1, wherein the joint is a braze joint.

6. An assembly for a turbine engine, comprising:

a titanium rotor having a dovetail slot in the circumference thereof, the dovetail slot including at least a pair of sidewalls diverging in a direction from the circumference toward an inward portion of the rotor, and terminating at a bottom;

a titanium blade having a dovetail sized to fit into the dovetail slot and contact the rotor along a pair of contacting regions on the inwardly diverging sidewalls of the dovetail slot, one contacting region being located on each side of the dovetail slot, there remaining a non-contacting region between the blade dovetail and the dovetail slot; and a multilayer shim disposed between the dovetail and the dovetail slot, the shim including:

(a) a first layer adjacent the dovetail slot and having an inner and an outer surface, the first layer having a slip-inhibiting material on the outer surface lying adjacent the contacting regions of the rotor dovetail slot, and a slip-promoting material on the inner surface oppositely disposed from the outer surface;

(b) a second layer adjacent the blade dovetail and having an inner and an outer surface, the second layer having a slip-inhibiting material on the inner surface lying adjacent the contacting regions of the blade dovetail, and a slip-promoting material on the outer surface oppositely disposed from the inner surface, the slip-inhibiting material of each layer being in contact with the adjacent titanium piece and acting to inhibit sliding movement between the shim and the titanium piece, and the slip-promoting material of the first layer being in contact with the slip-promoting material of the second layer such that relative movement between the blade dovetail and the dovetail slot is accommodated by sliding of the slip-promoting materials over each other;

(c) a high strength doubler overlying only that portion of the first layer that is disposed over the non-contacting region; and (d) a joint joining together the first layer and the doubler in the non-contacting region.

7. The assembly of claim 6, wherein the first layer and the second layer are formed of a nickel-base superalloy.

8. The assembly of claim 6, wherein the slip-inhibiting material is selected from the group consisting of copper and aluminum bronze.

9. The assembly of claim 6, wherein the slip-promoting material is selected from the group consisting of molybdenum disulfide, titanium nitride, poly(tetrafluoroethylene) and a lubricant comprising poly(tetrafluoroethylene), bentonite, inorganic oxide particles and an epoxy.

10. An assembly for a turbine engine, comprising:

a titanium rotor having a dovetail slot in a circumference thereof, the dovetail slot including at least a pair of sidewalls diverging in a direction from the circumference toward an inward portion of the rotor, and terminating at a bottom;

a titanium blade having a dovetail sized to fit into the dovetail slot and contact the rotor along a pair of contacting regions on the inwardly diverging sidewalls of the dovetail slot, one contacting region being located on each side of the dovetail slot, there remaining a non-contacting region between the blade dovetail and the dovetail slot; and a reinforcing shim disposed between the blade dovetail and the rotor dovetail slot, the shim including means for inhibiting fretting wear of the titanium dovetail and the titanium rotor in the contacting region of the dovetail slot, a strengthening doubler disposed in the non-contacting region and means for joining the doubler to the fretting-inhibiting means in the non-contacting region.

11. The assembly of claim 10, wherein the means for inhibiting includes an anti-fretting layer interposed between the blade dovetail and the rotor dovetail slot over the contacting regions.

12. The assembly of claim 10, wherein the means for inhibiting includes a high friction, soft coating on the shim adjacent to the respective adjacent titanium pieces.

13. A multilayer shim configured for placement between a dovetail slot of a titanium rotor and a titanium blade dovetail, the rotor dovetail slot in the circumference of the rotor including at least a pair of sidewalls diverging in a direction from the circumference toward an inward portion of the rotor, and terminating at a bottom, and the blade dovetail sized to fit into the rotor dovetail slot and contact the rotor along a pair of contacting regions on the inwardly diverging sidewalls of the rotor dovetail slot, one contacting region on each side of the rotor dovetail slot, there remaining a non-contacting region between the blade dovetail and the rotor dovetail slot bottom the shim comprising:

at least two material layers;

means for inhibiting fretting wear of the titanium dovetail and the titanium rotor in the contacting region of the dovetail slot;

a high strength doubler; and a joint int the non-contacting region joining the doubler to at least one of the material layers.

14. A multilayer shim configured for placement between a dovetail slot of a titanium rotor and a titanium blade dovetail, the rotor dovetail slot being located in the circumference of the rotor including inwardly inclined sidewalls and a bottom, and the titanium blade dovetail sized to fit into the rotor dovetail slot and contact the rotor along a pair of contacting regions on the inwardly inclined sidewalls of the rotor dovetail slot, one contacting region on each side of the rotor dovetail slot, there remaining a non-contacting region between the blade dovetail and the rotor dovetail slot bottom, the shim comprising:

(a) an anti-fretting layer interposed between the blade dovetail and the rotor dovetail slot over both the contacting regions and the non-contacting region, the anti-fretting layer being formed of a material that does not exhibit fretting when rubbed against titanium, (b) a doubler having higher strength than the anti-fretting layer and overlying only that portion of the anti-fretting layer that is disposed over the non-contacting region and affixed to at least a part of the anti-fretting layer; and (c) a joint located in the non-contacting region joining together the anti-fretting layer and the doubler.

15. A multilayer shim configured for placement between a dovetail slot of a titanium rotor and a titanium blade dovetail, the rotor dovetail slot in the circumference of the rotor including at least a pair of sidewalls diverging in a direction from the circumference toward an inward portion of the rotor, and terminating at a bottom, and the titanium blade dovetail sized to fit into the dovetail slot and contact the rotor along a pair of contacting regions on the inwardly diverging sidewalls of the rotor dovetail slot, one contacting region on each side of the rotor dovetail slot, the shim comprising:

a first layer adjacent the dovetail slot, the first layer having a slip-inhibiting material on an outer surface lying adjacent the contacting regions of the dovetail slot, and a slip-promoting material on an inner surface oppositely disposed from the outer surface, a second layer adjacent the dovetail, the second layer having a slip-inhibiting material on an inner surface lying adjacent the contacting regions of the dovetail, and a slip-promoting material on an outer surface oppositely disposed from the inner surface, the slip-inhibiting material of each layer being in contact with the adjacent titanium piece and acting to inhibit sliding movement between the shim and the titanium piece;

the slip-promoting material of the first layer being in contact with the slip-promoting material of the second layer such that relative movement between the dovetail and the dovetail slot is accommodated by sliding of the slip-promoting materials over each other;

a high strength doubler adjacent the outer surface of the first layer between the first layer and the dovetail slot bottom in a non-contacting region; and a joint in the non-contacting region joining the high strength doubler to the first layer.

* * * * *